US006446367B1

(12) United States Patent
Muramoto et al.

(10) Patent No.: US 6,446,367 B1
(45) Date of Patent: Sep. 10, 2002

(54) TRACTOR-LOADER-BACKHOE

(75) Inventors: Naoya Muramoto; Tsuyoshi Aoki, both of Sakai; Shoichiro Kawamura, Hannnann; Toshihiko Takemura, Izumi, all of (JP)

(73) Assignee: Kubota Corporation (JP)

( * ) Notice: Subject to any disclaimer, the term of this patent is extended or adjusted under 35 U.S.C. 154(b) by 0 days.

(21) Appl. No.: 09/520,086

(22) Filed: Mar. 7, 2000

(30) Foreign Application Priority Data

Mar. 24, 1999 (JP) ..... 11-080074
Mar. 24, 1999 (JP) ..... 11-080076

(51) Int. Cl.[7] ..... E02F 3/627
(52) U.S. Cl. ..... 37/410; 172/275; 414/686
(58) Field of Search ..... 37/403, 410; 172/272, 172/274, 275; 414/686, 694

(56) References Cited

U.S. PATENT DOCUMENTS 4,498,839 A * 2/1985 Williams et al. ..... 414/686
4,565,989 A 1/1986 Lotter et al. ..... 337/311
4,755,101 A 7/1988 Hamada et al. ..... 414/686
4,802,814 A 2/1989 Kourogi et al. ..... 414/686
5,000,269 A * 3/1991 Aoki et al. ..... 172/248
5,536,134 A 7/1996 Hirooka ..... 414/686
5,927,665 A * 7/1999 Grabnic ..... 248/200
6,056,502 A * 5/2000 Takemura et al. ..... 414/686

FOREIGN PATENT DOCUMENTS

GB 2256213 A * 2/1992

* cited by examiner

*Primary Examiner*—Thomas B. Will
*Assistant Examiner*—Meredith C. Petravick
(74) *Attorney, Agent, or Firm*—Webb Ziesenheim Logsdon Orkin & Hanson, P.C.

(57) ABSTRACT

A TLB includes a tractor body, a reinforcing frame disposed around the tractor body and supported by the tractor body, a pair of right and left side frames for pivotably supporting a pair of right and left booms having a loader bucket attached to distal ends thereof, and braces for connecting the side frames to the tractor body. The side frames are connected to the reinforcing frames by at least two connecting bosses attached to the side frames, at least two connecting bosses attached to the reinforcing frame, and pins inserted through bores of the connected bosses and bores of the connecting bosses. Rear positions of the reinforcing frame are attached to cylindrical portions of rear axle cases by holders rotatable about an axis of the cylindrical portions, and mounting members for connecting the holders to the reinforcing frame, respectively.

8 Claims, 18 Drawing Sheets

TRACTOR-LOADER-BACKHOE

BACKGROUND OF THE INVENTION

1. Field of the Invention

This invention relates to a working vehicle having a front loader attached to the front of a tractor, and mainly to a working vehicle called a TLB (tractor-loader-backhoe) having a front loader attached to the front of a tractor, and a backhoe attached to the rear of the tractor.

2. Description of the Related Art

Conventionally, there is a working vehicle called a TLB which has a front loader attached to the front of a tractor, and a backhoe attached to the rear of the tractor.

In the TLB, the tractor includes a reinforcing frame extending longitudinally thereof. The front loader is attached to the front end of the reinforcing frame, and the backhoe to the rear end of the reinforcing frame.

The front loader includes side frames in post form attached to the reinforcing frame, braces for connecting the side frames to the tractor, booms attached to the side frames to be vertically pivotable by boom cylinders, and a bucket disposed at distal ends of the booms to be actuated by a bucket cylinder to perform scooping and dumping operations.

Regarding the TLB in operation, a load is applied to the side frames during an operation with the front loader. In addition, during an operation of the backhoe, the front loader is used as a stabilizer with the bucket of the front loader placed in contact with the ground. Thus, during an operation of the backhoe also, a load is applied to the side frames through the reinforcing frame.

The braces are provided to connect the side frame to the tractor, so that the load applied to the side frames is distributed to the braces. However, where the side frames are rigidly joined to the reinforcing frame, stress tends to concentrate on the joints therebetween, and it is difficult to distribute the load from the side frames to the braces. However, where the side frames are connected to the reinforcing frame in a fully free contact mode simply to receive the load, a drawback arises with respect to stability of the front loader.

In one construction to attach the side frames to the reinforcing frame, lower positions of the side frames are fitted, to be pivotable about a transverse axis, from above to loader mounts attached to the reinforcing frame, and upper positions of the side frames are pinned to the loader mounts. In this construction, the lower fitting positions of the side frames have considerable play, and an excessive load is transmitted from the side frames to the braces. This requires the braces to be reinforced. Particularly during an excavating operation with the backhoe attached to the tractor, with the bucket of the front loader placed on the ground to use the front loader as a stabilizer, the above construction has a drawback that the front loader cannot fully bear the load transmitted from the backhoe.

SUMMARY OF THE INVENTION

An object of this invention is to allow a load applied to the side frames to be distributed smoothly to the braces, to appropriately reduce the stress concentration on the portions of the side frame fixed to the reinforcing frame.

The above object is fulfilled, according to this invention, by a tractor comprising a tractor body, a reinforcing frame disposed around the tractor body and supported by the tractor body, a pair of right and left side frames for pivotably supporting a pair of right and left booms having a loader bucket attached to distal ends thereof, braces for connecting the side frames to the tractor body, and a connecting device for connecting the side frames to the reinforcing frame, the connecting device including at least two connected bosses attached to the side frames, at least two connecting bosses attached to the reinforcing frame, and pins inserted through bores of the connected bosses and bores of the connecting bosses.

With this construction, the side frames are not so fully rigidly joined to loader mounts of the reinforcing frame as by tightening bolts. Though very slight, movement is allowed so that a load applied to the side frames may be distributed (released) to the braces. As a result, without reinforcing the mounts that attach the side frames to the reinforcing frame, the front loader, and a backhoe attached as necessary, may perform operations with increased power.

Since the load applied to the side frames may be released appropriately to the braces, components of the reinforcing frame may have a small wall thickness to achieve reductions in weight and cost. The pin connection realizes a reduction in assembling steps, a simplified construction and low cost.

Further, in this invention, a rear mounting device is provided for attaching rear positions of the reinforcing frame to cylindrical portions of rear axle cases. The rear mounting device includes holders rotatable about an axis of the cylindrical portions, and mounting members for connecting the holders to the reinforcing frame, respectively. Preferably, the mounting members and the holders are bolted to together.

Such a mounting structure at the rear end of the reinforcing frame in combination with the mounting structure (pin connection) for attaching the side frames to the reinforcing frame effectively distributes the load acting on the reinforcing frame during a backhoe operation to the entire reinforcing frame and the entire front loader. Consequently, the reinforcing frame may be simplified and lightened.

Since the holders are mounted on the rear axle cases to be rotatable about the axis thereof, and bolted to the rear end of the reinforcing frame, the reinforcing frame is attached with errors in mounting dimension due to a welding distortion or the like of the reinforcing frame absorbed by play in rotation of the holders and in bolt receiving bores, and without producing a stress of assembly.

Other features and advantages of this invention will be apparent from the following description of the embodiment to be taken with reference to the drawings.

DESCRIPTION OF THE PREFERRED EMBODIMENT

An embodiment of this invention will be described hereinafter with reference to the drawings.

Figure 1:
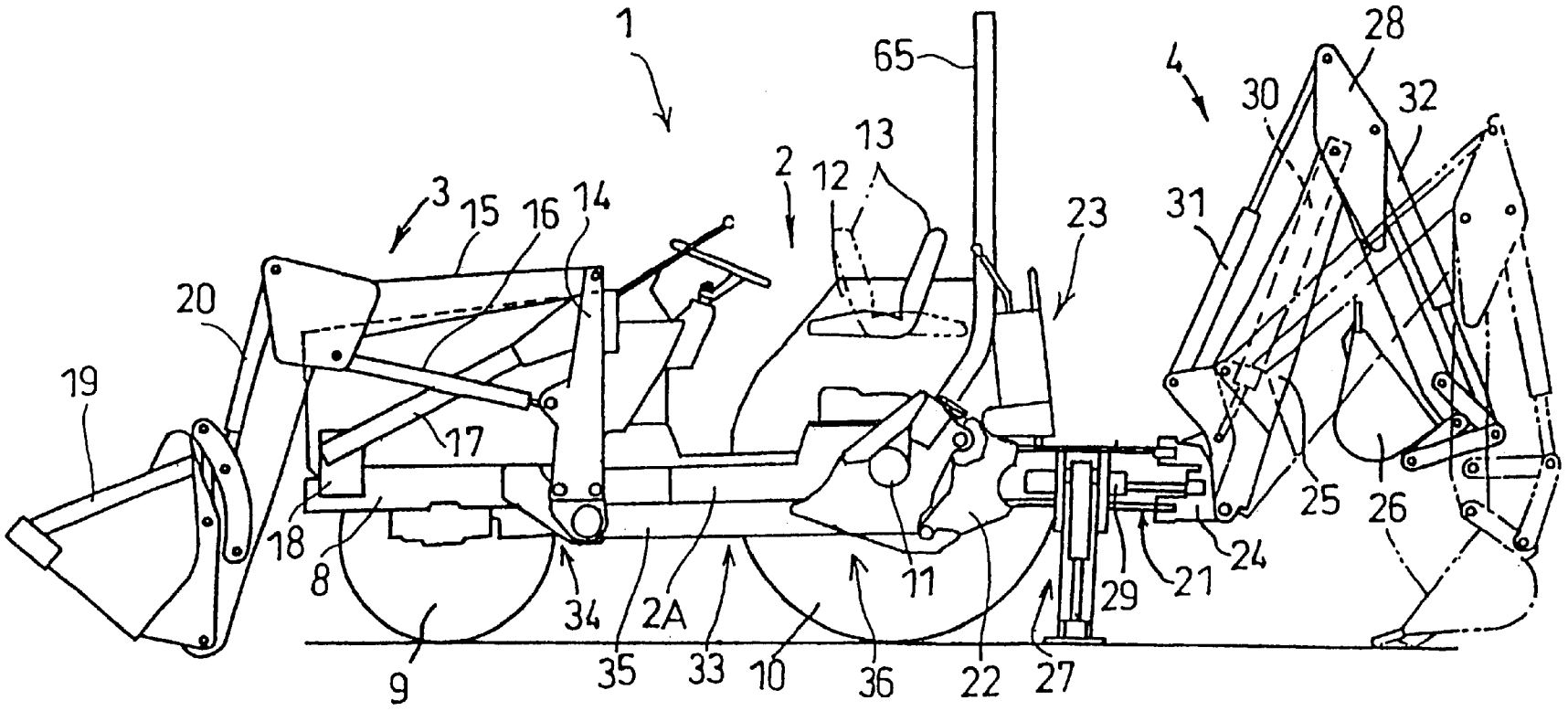
FIG. 1 is a side elevation of a TLB.

In FIG. 1, the working vehicle 1 shown is a TLB (tractor-front loader-backhoe). A tractor 2 includes a tractor body 2A having a front loader 3 attached to the front thereof and a backhoe 4 attached to the rear thereof.

Figure 2:
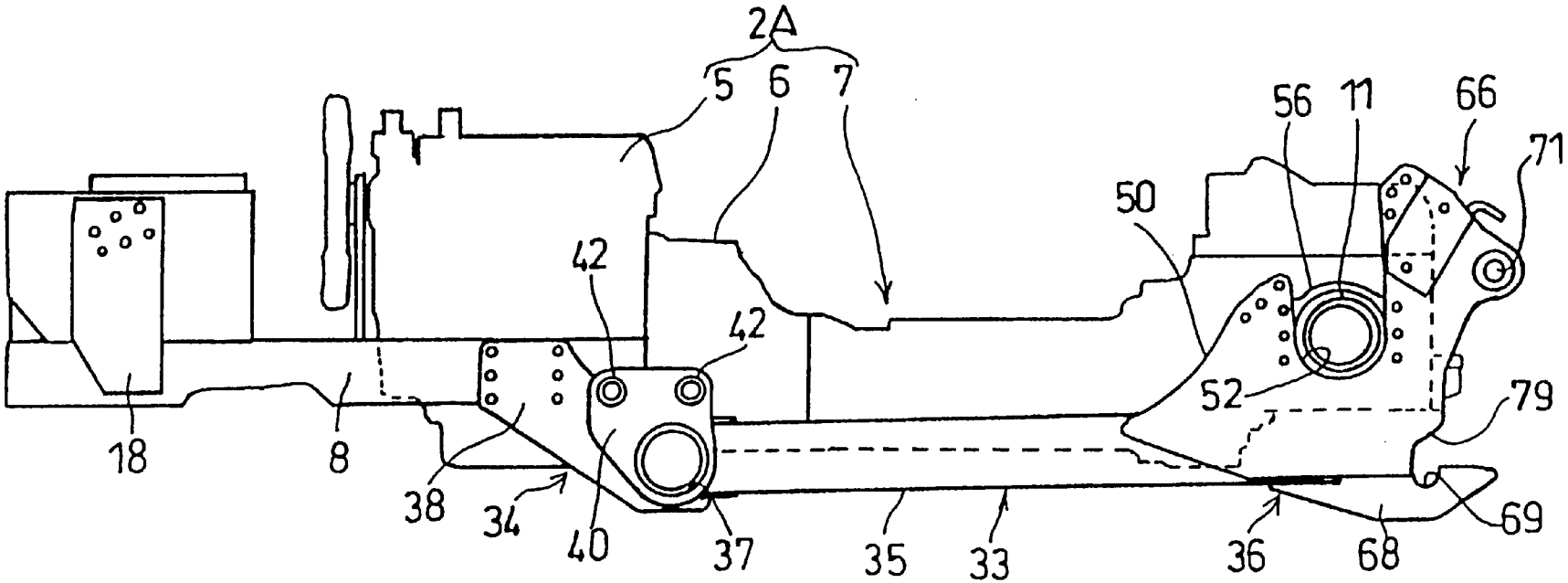
FIG. 2 is a side view of a reinforcing frame and a tractor body.
Figure 3:
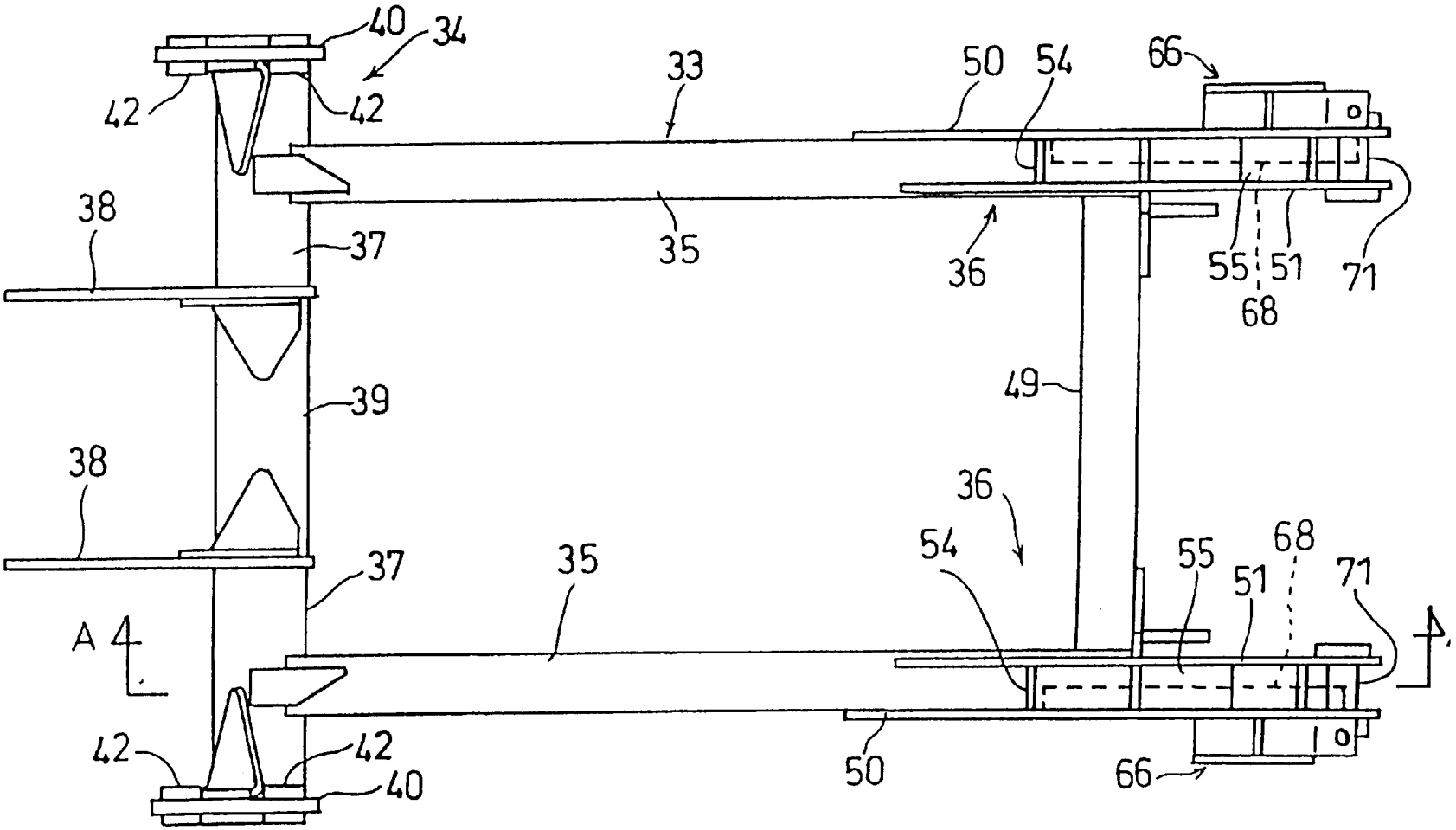
FIG. 3 is a plan view of the reinforcing frame.
Figure 4:
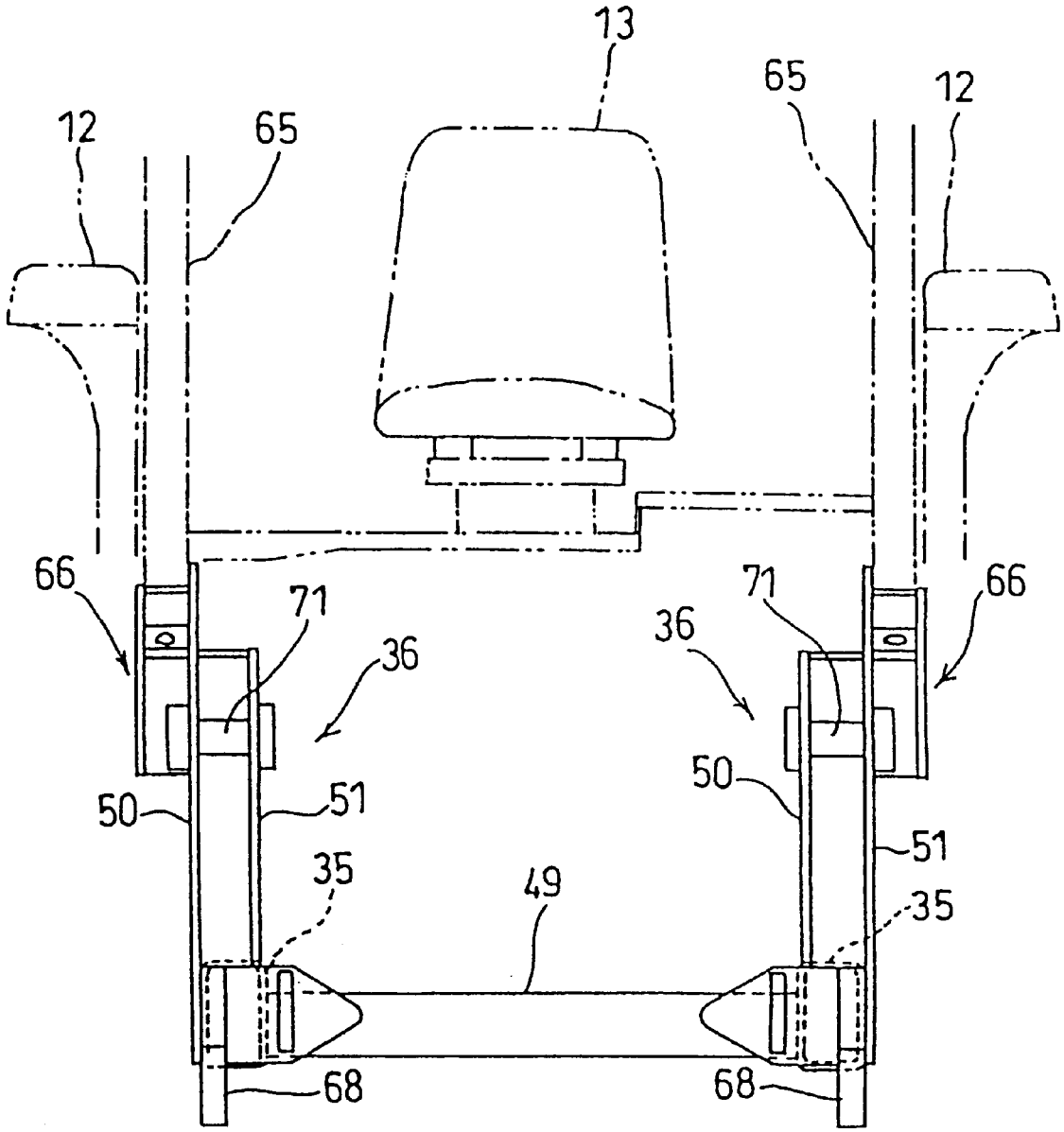
FIG. 4 is a rear view of the reinforcing frame.
Figure 5:
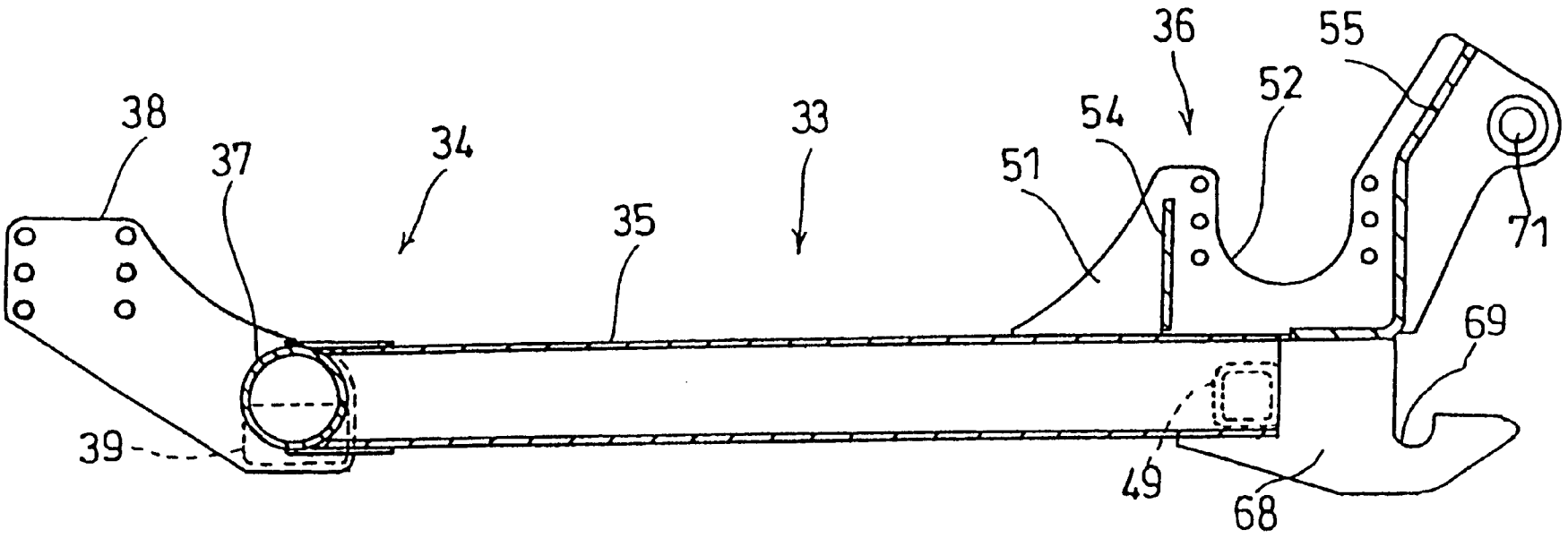
FIG. 5 is a section taken on line A—A of FIG. 3.
Figure 6:
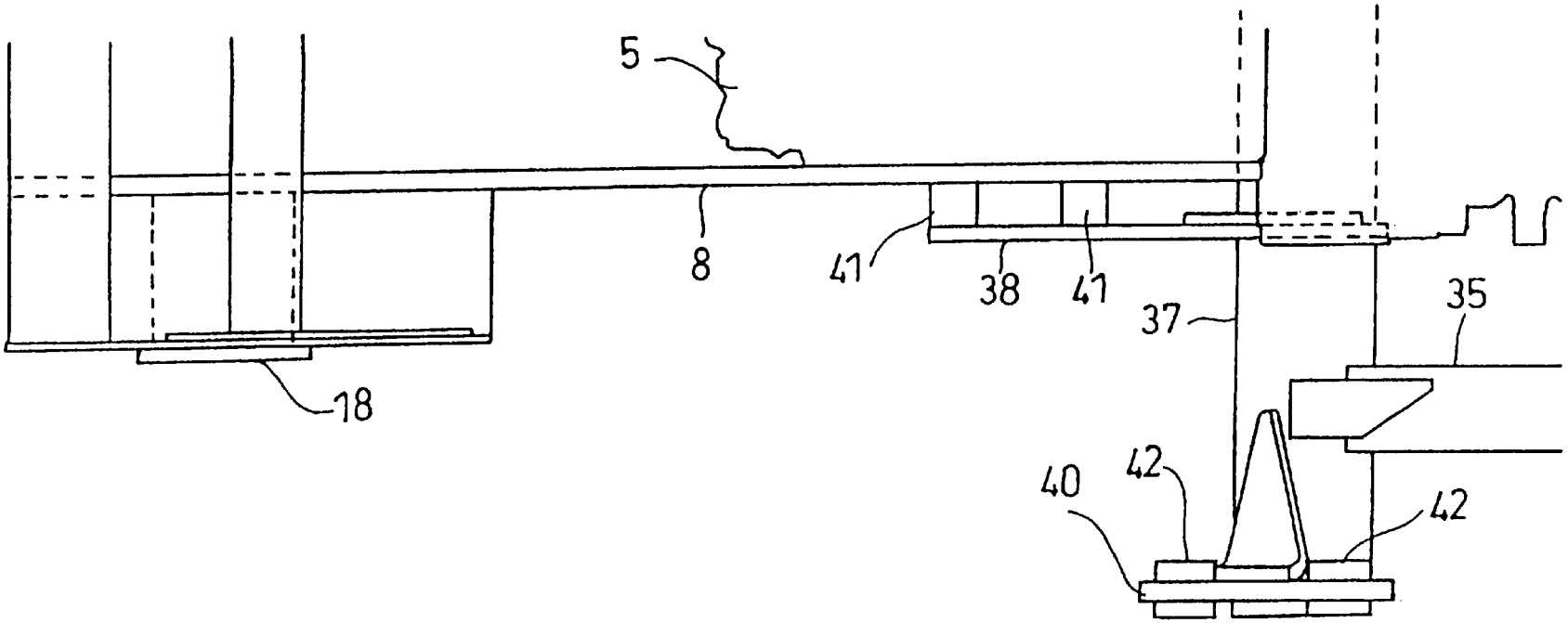
FIG. 6 is a plan view of a front portion of the reinforcing frame.
Figure 7:
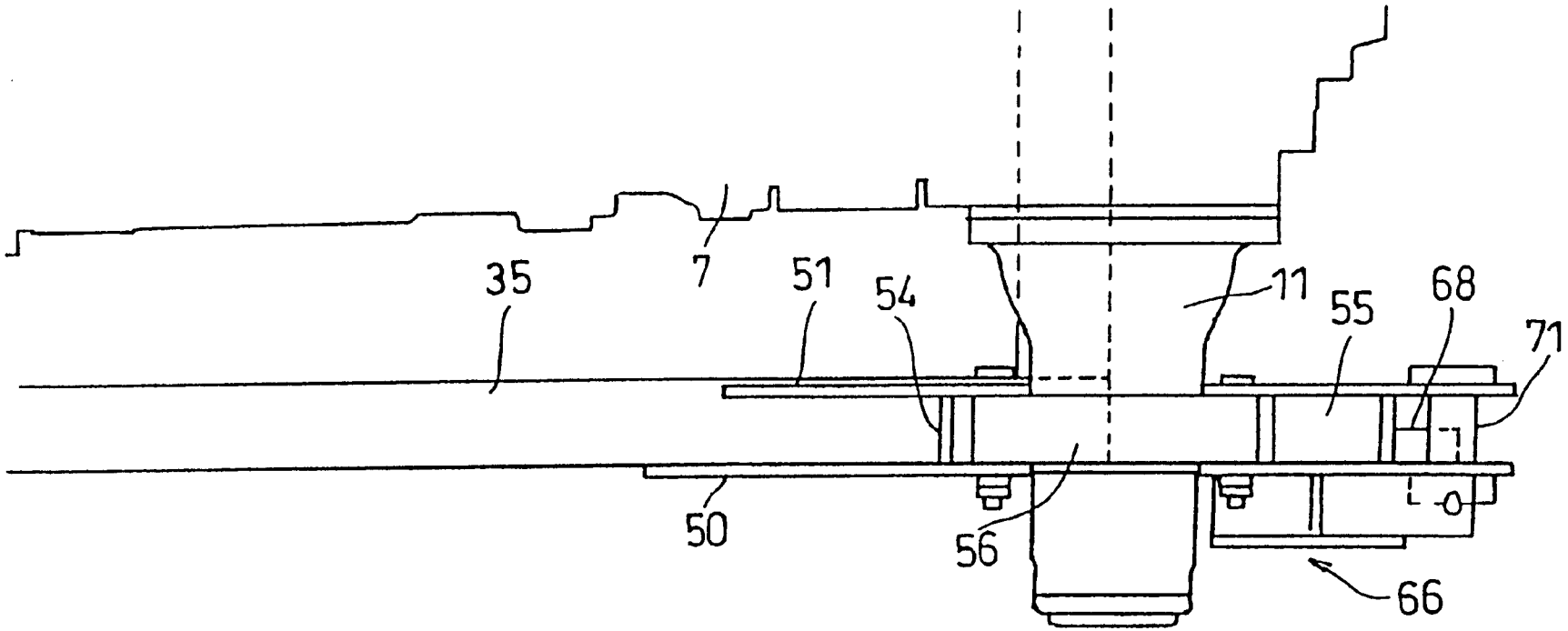
FIG. 7 is a plan view of a rear portion of the reinforcing frame.
Figure 8:
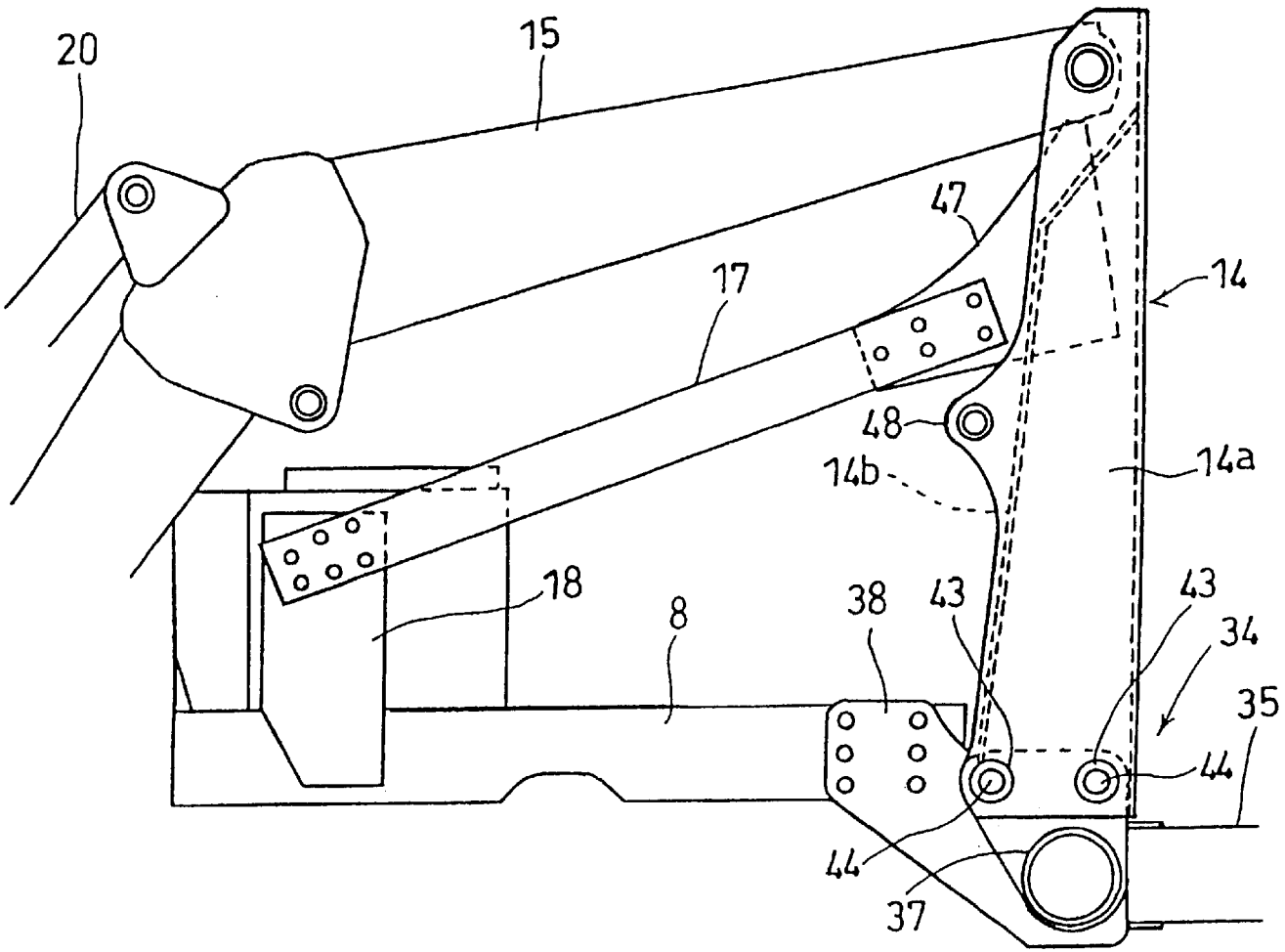
FIG. 8 is a side view of a front portion of the TLB.
Figure 9:
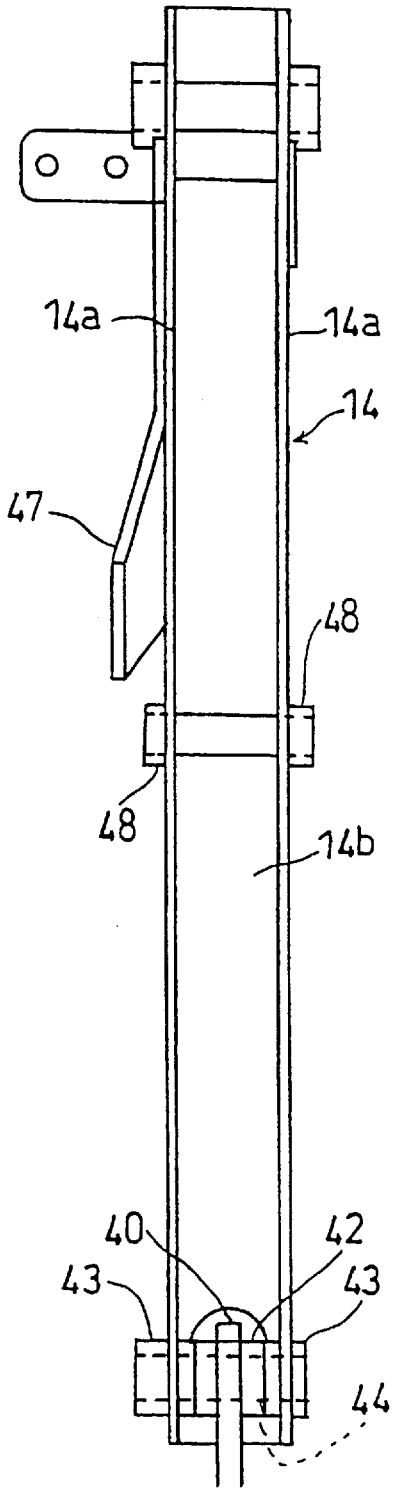
FIG. 9 is a front view of a left side frame portion.
Figure 10:
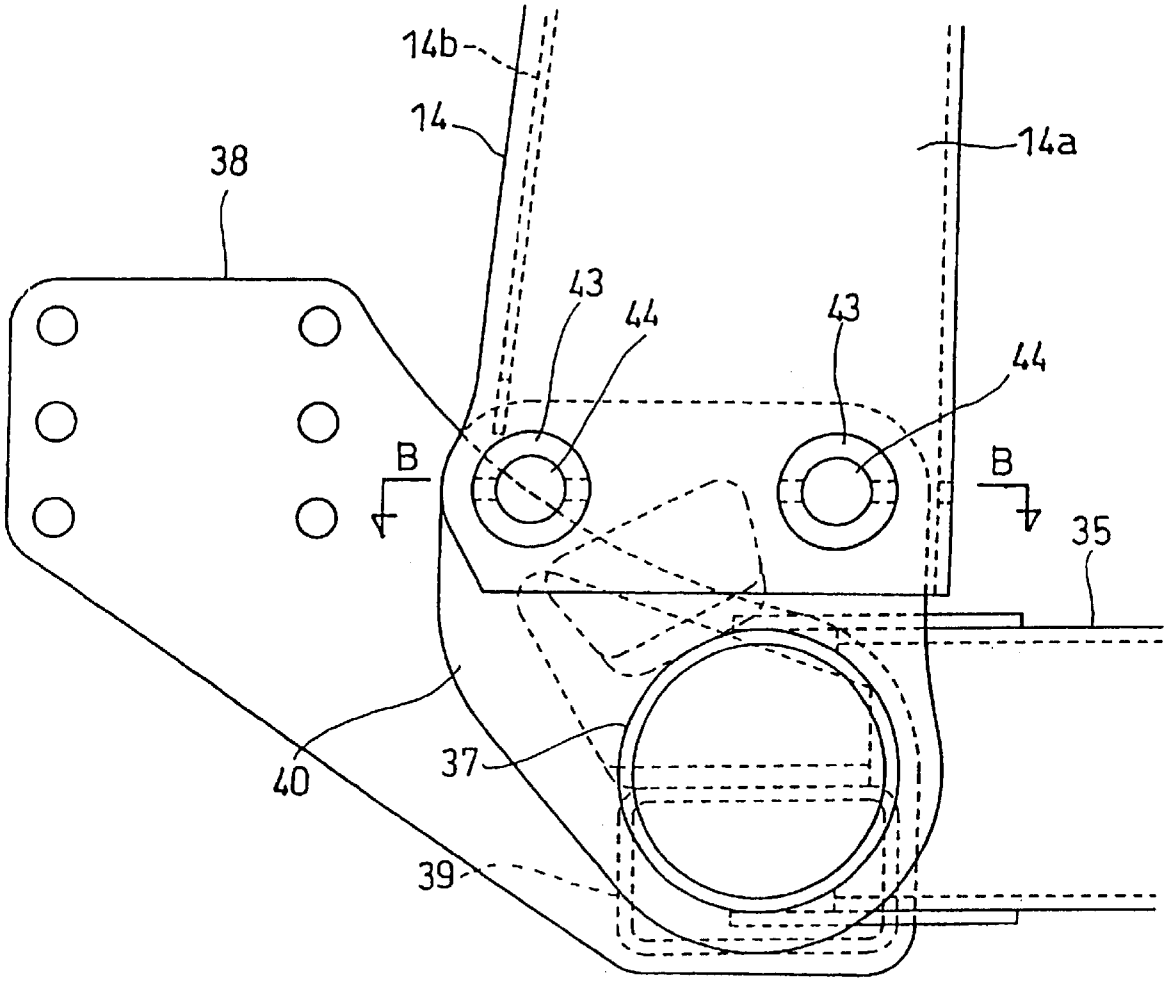
FIG. 10 is an enlarged side view of a side frame mounting structure.
Figure 11:
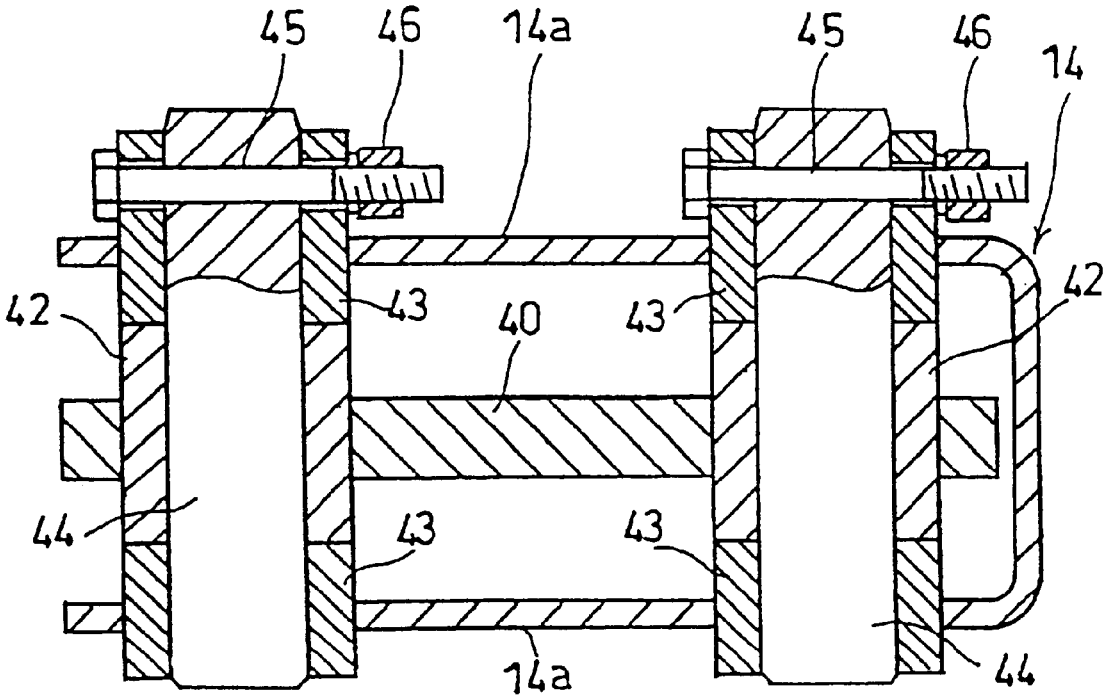
FIG. 11 is a section taken on line B—B line of FIG. 10.
Figure 12:
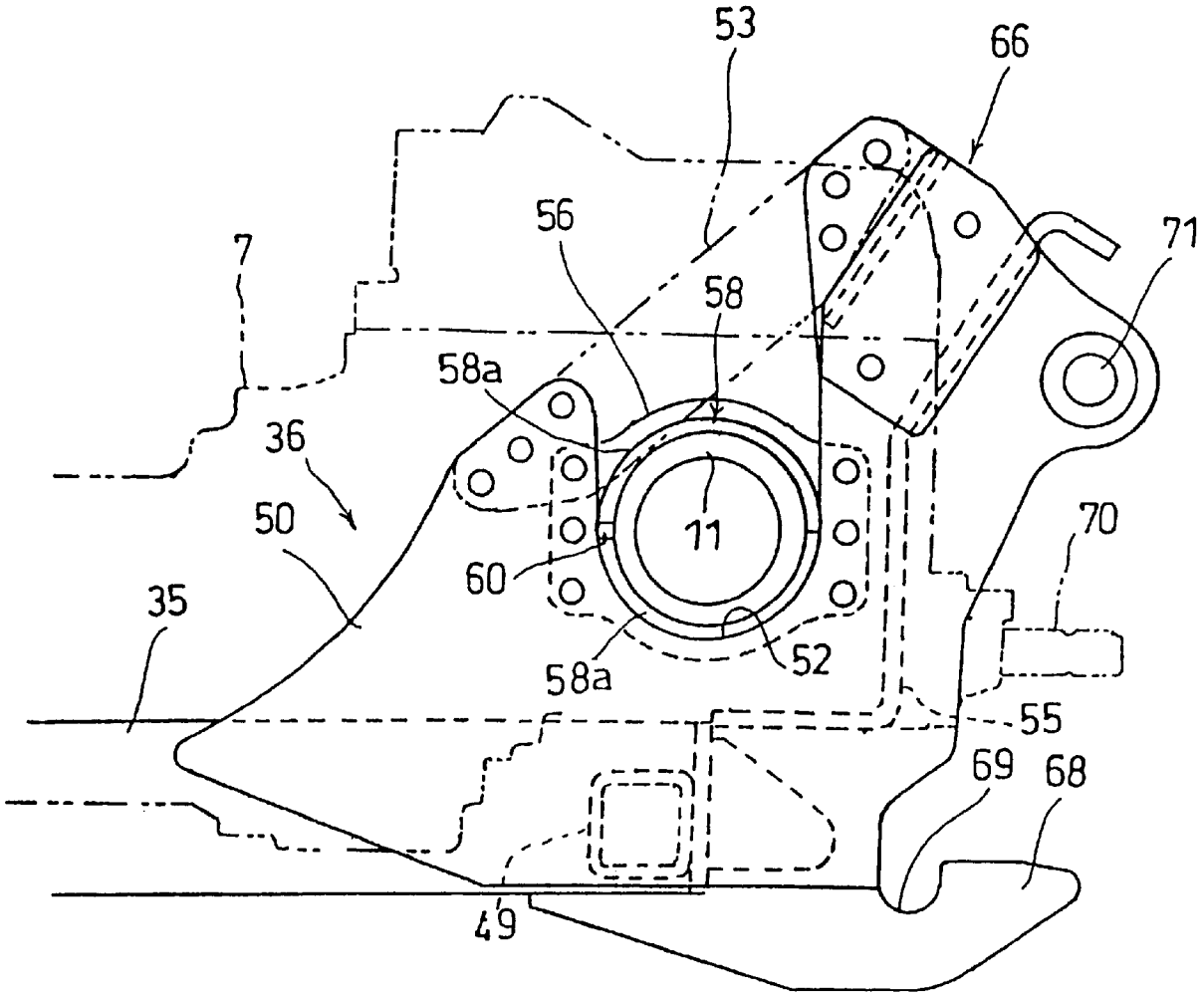
FIG. 12 is a side view of a rear portion of the reinforcing frame.
Figure 13:
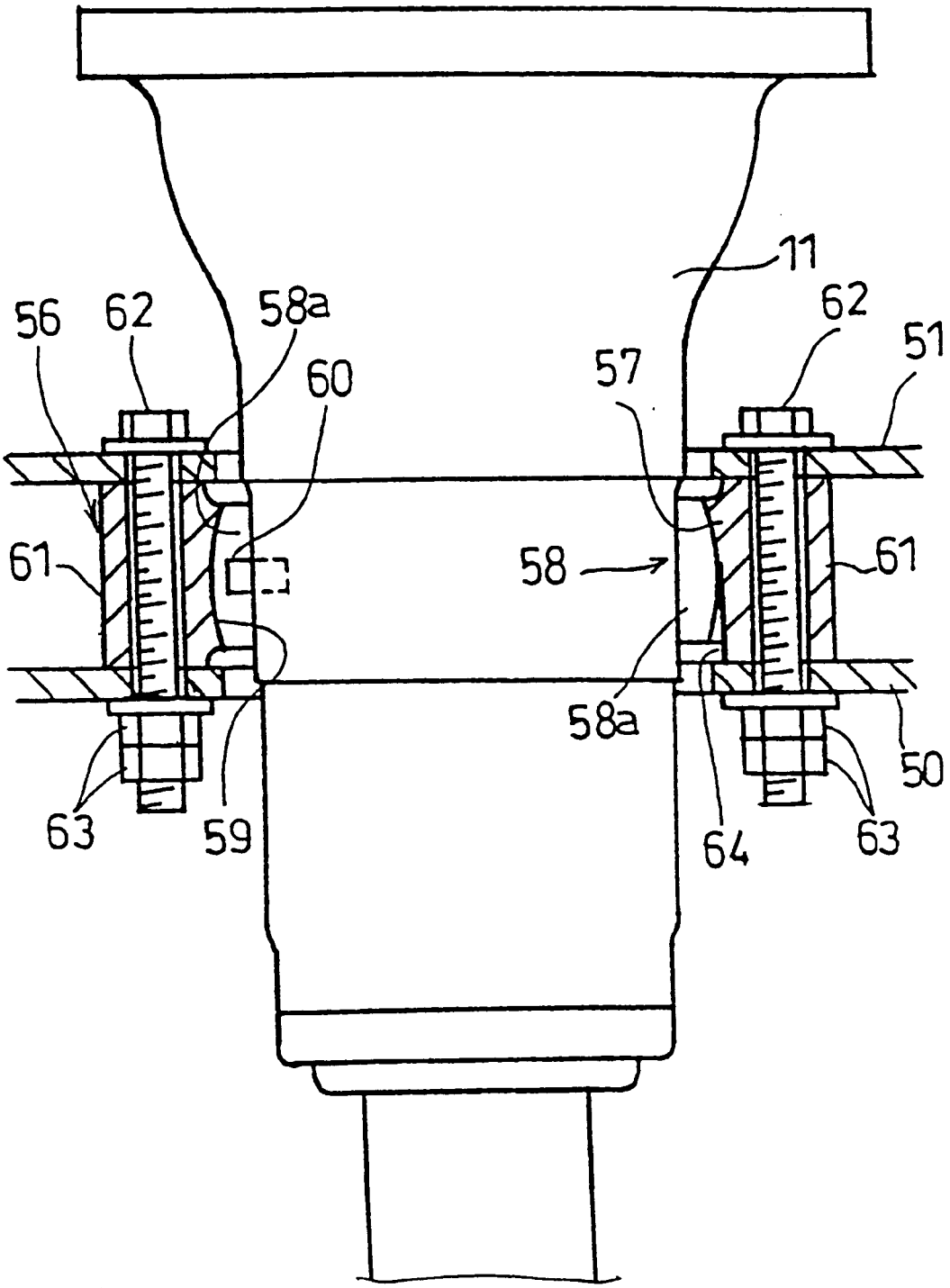
FIG. 13 is a sectional plan view of a mounting structure in the rear portion of the reinforcing frame.

As shown in FIG. 2, the tractor body 2A includes an engine 5, a flywheel housing, a clutch housing 6 and a transmission case 7 arranged in the fore and aft direction and directly interconnected to one another. The tractor 2 runs on a pair of right and left front wheels 9 and a pair of right and left rear wheels 10 supporting the tractor body 2A.

Front axle frames 8 are fixed to lower right and left sides of engine 5 by a plurality of bolts, and extend forward from the sides of engine 5. The front axle frames 8 also form part of the tractor body 2A.

Rear axle cases 11 are fixed to rearward portions of the tractor body 2A. The rear axle cases 11 project from opposite, right and left sides of the transmission case 7 extending of the tractor body 2A. The rear axle cases 11 support rear axles rotatable about a transverse axis and which support the rear wheels 10.

Rear wheel fenders 12 are attached to the right and left rear axle cases 11, respectively. A driver's seat 13 is disposed between the right and left rear wheel fenders 12.

The driver's seat 13 is supported, to be pivotable about a vertical axis, on a floor sheet disposed on the transmission case 7. The driver's seat 13 is pivotable between a forward facing position (shown in a solid line in FIG. 1) for the operator to control the tractor 2 and front loader 3, and a rearward facing position (shown in a phantom line in FIG. 1) for the operator to control the backhoe 4.

The tractor 2 has control levers arranged at the night side of the driver's seat 13. A space is formed between the driver's seat 13 and left rear wheel fender 12 to provide a passage for the operator.

In this TLB 1, the driver's seat 13 supported to be rotatable about the vertical axis has the rearward facing position not displaced to a large extent rearward relative to the forward facing position. The backhoe 4 is disposed the closer to the tractor 2 by a corresponding amount, which achieves an improved weight balance, a reduction of the load acting on a reinforcing frame 33 described later, and a compact construction.

The front loader 3 includes, provided in right and left pairs at the front of tractor 2, side frames 14, booms 15 connected to upper positions of the side frames 14 to be pivotable about a transverse axis, boom cylinders 16 extending between intermediate positions of booms 15 and the side frames 14 for raising and lowering the booms 15, and braces 17 for interconnecting the side frames 14 and brackets 18 fixed as by welding to forward positions of front axle frames 8. A bucket 19 is supported between forward ends of the right and left booms 15 to perform scooping and dumping operations. The bucket 19 is actuated by a bucket cylinder 20 extending between the booms 15 and bucket 19.

The backhoe 4 includes a base block 21, right and left mounting elements 22 fixed to the front of base block 21, a control device 23 mounted on the base block 21, a swing deck 24 connected to the rear of base block 21 to be pivotable right and left about a vertical axis, a boom 25 connected to the swing deck 24 to be pivotable about a transverse axis, an arm 28 connected to a distal end of boom 25 to be pivotable about a transverse axis, a bucket 26 supported at a distal end of arm 28 to perform scooping and dumping operations, and outriggers 27 disposed at opposite, right and left sides of base block 21.

The base block 21 supports a swing cylinder 29 for swinging the swing deck 24 right and left. A boom cylinder 30 extends between the swing deck 24 and boom 25 for vertically swinging the boom 25. An arm cylinder 31 extends between the boom 25 and arm 28 for swinging the arm 28. A bucket cylinder 32 extends between the arm 28 and bucket 26 for actuating the bucket 26.

Each of the right and left outriggers 27 includes a leg and a hydraulic cylinder as main components thereof. The leg has one end thereof attached to the base block 21 to be vertically pivotable about an axis extending longitudinally of the tractor body, and the other end with a ground-engaging plate. The hydraulic cylinder is disposed between the leg and base block 21 for vertically swinging the leg.

The tractor body 2A includes a reinforcing frame 33 for attaching the front loader 3 and backhoe 4.

The reinforcing frame 33 is fixed at a forward end thereof to the front axle frames 8, and at a rearward end to the rear axle cases 11. Broadly, the reinforcing frame 33 includes a front frame portion 34, right and left side frame portions 35 and rear frame portions 36.

As shown in FIGS. 2 trough 7, the front frame portion 34 includes a pair of right and left cross members 37 formed of round pipe and disposed at opposite, right and left sides of a forward portion of tractor body 2A, a pair of right and left front mounting members 38 formed of a plate material and fixed as by welding to transversely inward ends of cross members 37. A connecting member 39 extending transversely under the forward portion of tractor body 2A and interconnects the right and left front mounting members 38 and the right and left cross members 37. Loader mounting members 40 are formed of a plate material and are fixed, such as by welding, to transversely outward ends of right and left cross members 37, and reinforcing members.

The right and left front mounting members 38 extend forward and upward from the cross members 37 fixed as by bolts to mounts 41 of front axle frames 8 on lower lateral surfaces of engine 5.

Each of the right and left loader mounting members 40 has a pair of front and rear cylindrical connecting bosses 42 extending through and welded to upper positions thereof.

On the other hand, as shown in FIGS. 8 through 11, each of the right and left side frames 14 of front loader 3 includes a channel member opening forward, and a reinforcing plate 14*b* fixed by welding to right and left side walls 14*a* to close the forward opening.

A pair of front and rear cylindrical bosses 43 extend transversely through and are welded to lower positions of the right and left side walls 14*a* of each side frame 14. These bosses 43 have inside and outside diameters similar to those of the connecting bosses 42 of the loader mounting members 40.

The lower ends of right and left side frames 14 are placed on the right and left loader mounting members 40, with each loader mounting member positioned between the right and left side walls 14*a* and axes of the bosses 42 and 43 aligned. Pins 44 are inserted transversely through the bosses 42 and 43. In this way, the side frames 14 are attached and pinned in a plurality of positions to the loader mounting members 40 of reinforcing frame 33.

The pins 44 are retained in place by bolts 45 extending through the pins 44 and the bosses 43 of side frame 14. The bolts 45 are retained in place by nuts 46 screwed to the bolts 45.

The side frames 14 include brace mounts 47 attached to upper positions thereof to which the braces 17 extending forward and downward are bolted. The booms 15 are pivotally connected to positions above the brace mounts 47, and the boom cylinders 16 are pivotally connected to mounts 48 disposed below the brace mounts 47.

The right and left side frame portions 35 extend fore and aft along the right and left sides of tractor body 2A. The side frame portions 35 have forward ends thereof fixedly connected by welding to the cross members 37 of front frame portion 34.

The rear ends of right and left side frame portions 35 are interconnected through a connecting member 49 extending transversely below a rear portion of transmission case 7.

As shown in FIGS. 3–5, 7 and 12–15, the rear frame portions 36 are disposed in rear positions of the right and left side frame portions 35, respectively.

Each rear frame portion 36 has a pair of right and left rear mounting members 50 and 51 formed of a plate material. The outer rear mounting member 50 is fixed by welding to a transversely outward surface one of the side frame portions 35. The inner rear mounting member 51 is fixed by welding to a transversely inward end on an upper surface of the side frame portion 35. The right and left rear mounting members 50 and 51 are transversely opposed to each other with a spacing therebetween.

The right and left rear mounting members 50 and 51 define recesses 52 opening upward for fitting on one of the rear axle cases 11 from below and receiving a cylindrical portion of the rear axle case 11. The outer rear mounting member 50 has a connecting plate 53 bolted thereto for closing an upper opening portion of the recess 52. The right and left rear mounting members 50 and 51 are interconnected by reinforcing members 54 and 55 disposed forwardly and rearwardly of the recesses 52.

The right and left rear mounting members 50 and 51 are attached to and supported by the rear axle case 11 through a holder 56 mounted on the rear axle case 11.

The holder 56 is of a pillow block structure having a case 57, and a substantially ring-shaped collar 58 fitted in a transverse engaging bore 59 formed in the case 57.

The engaging bore 59 of case 57 has an inner peripheral surface acting as a curved slip surface. The collar 58 has an outer peripheral surface curved to fit with the inner peripheral surface of engaging bore 59.

The collar 58 has a substantially circular inner peripheral surface. The rear axle case 11 extends through the collar 58 (holder 56), with the holder 56 fitting on the rear axle case 11.

The holder 56 is disposed between the right and left, rear mounting members 50 and 51. The case 57 has mounts 61 projecting from front and rear positions thereof. The holder 56 is fixed to the reinforcing frame 33 by bolts 62 extending transversely through the mounts 61 and the right and left rear mounting members 50 and 51 (i.e. bolts 62 extending parallel to the axis of rear axle case 11) and nuts 63 screwed to the bolts 62.

Thus, the rear portions of reinforcing frame 33 are attached to the rear axle cases 11 through the holders 56 to be pivotable about the axis of the cylindrical portions of rear axle cases 11, tiltable relative to the axis of rear axle cases 11, and movable along the axis of rear axle cases 11. This construction restrains a bending, twisting or like load acting on the reinforcing frame 33 from being transmitted to the tractor body 2A.

During an operation with the backhoe 4, a stress concentration on the rear mounting portions of reinforcing frame 33 is avoided, and a load acting on the reinforcing frame 33 may be distributed over the entire reinforcing frame 33.

The collar 58 is circumferentially divided into two parts, i.e. two substantially semicircular half collars 58*a*.

The engaging bore 59 of holder 56 includes a cutout 64 extending halfway circumferentially of the bore, and from one axial end to an axially intermediate position of bore 59 for axially inserting the half collars 58*a*.

The collar 58 may be circumferentially divided into three or more parts. The collar 58 will serve the purpose as long as it is divided into a plurality of parts. The cutout 64 is formed to have a circumferential length corresponding to one divided part of the collar 58.

Each rear axle case 11 has a pin 60 (stopper) projecting radially from a position of the cylindrical portion on which the collar 58 is mounted.

Figure 16:
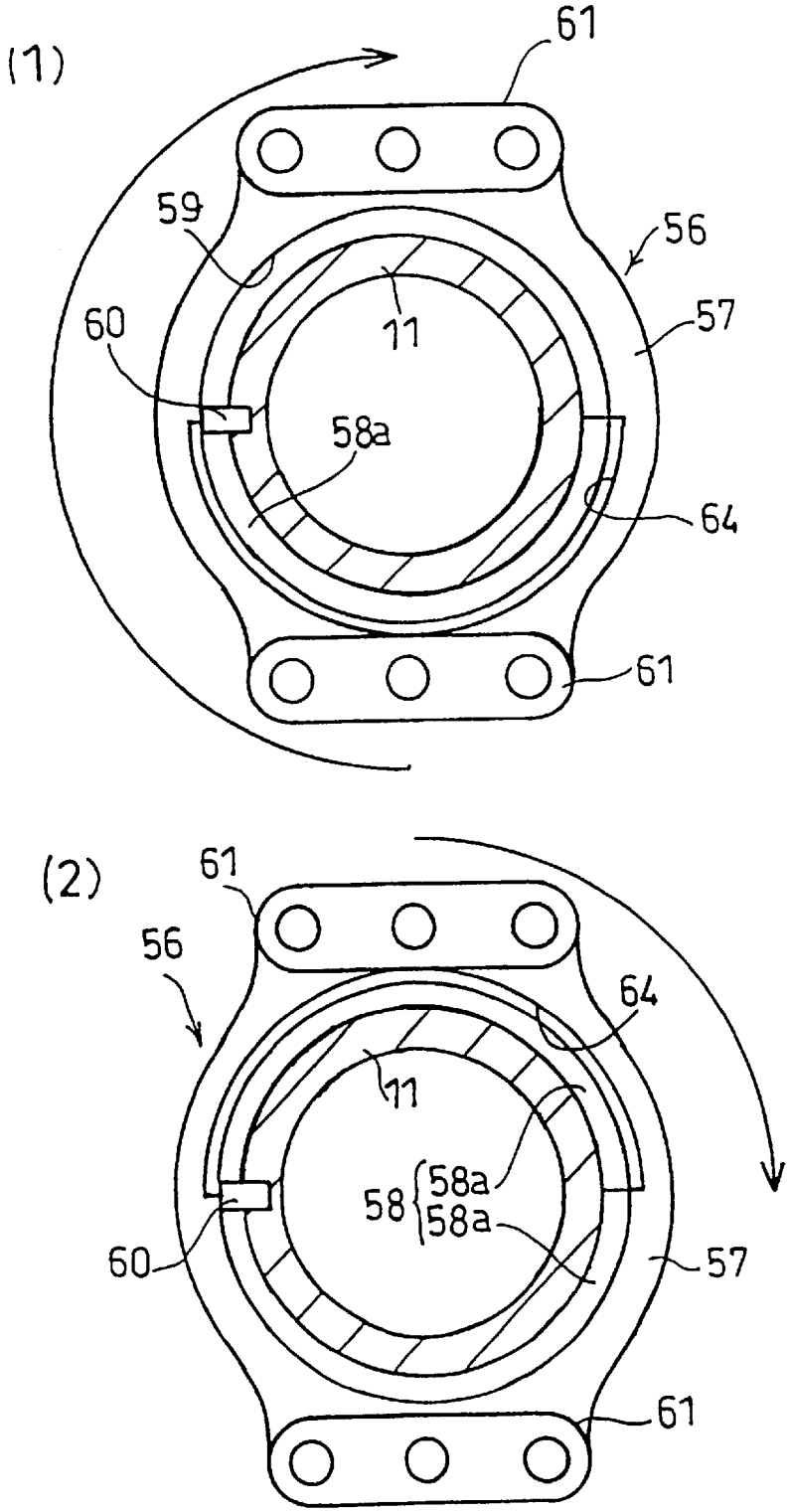
FIGS. 16(1) and 16(2) are explanatory side views of the holder assembled to a rear axle case.

To each holder 56 having the above construction to the rear axle case 11, as shown in FIG. 16(1), for example, the case 57 is fitted on the rear axle case 11, with the mounts 61 of case 57 disposed upward and downward, and the cutout 64 disposed downward. The pin 60 on the rear axle case 11 is disposed leftward in the drawing.

In this state, one of the components of collar 58 (i.e. half collar 58*a*) is inserted from the cutout 64 into the engaging bore 59.

Next, the case 57 is rotated 180 degrees in the direction indicated by an arrow in FIG. 16(1), to place the cutout 64 opposite the one component of collar 58 as shown in FIG. 16(2). The one component of collar 58 inserted first is restricted by the pin 60 from movement in the direction indicated by the arrow in FIG. 16(1).

Next, the other component of collar 58 is inserted from the cutout 64 into the engaging bore 59. As a result, the collar 58 having a spherical outer peripheral surface is readily fitted in the engaging bore 59 having a spherical inner peripheral surface.

Figure 14:
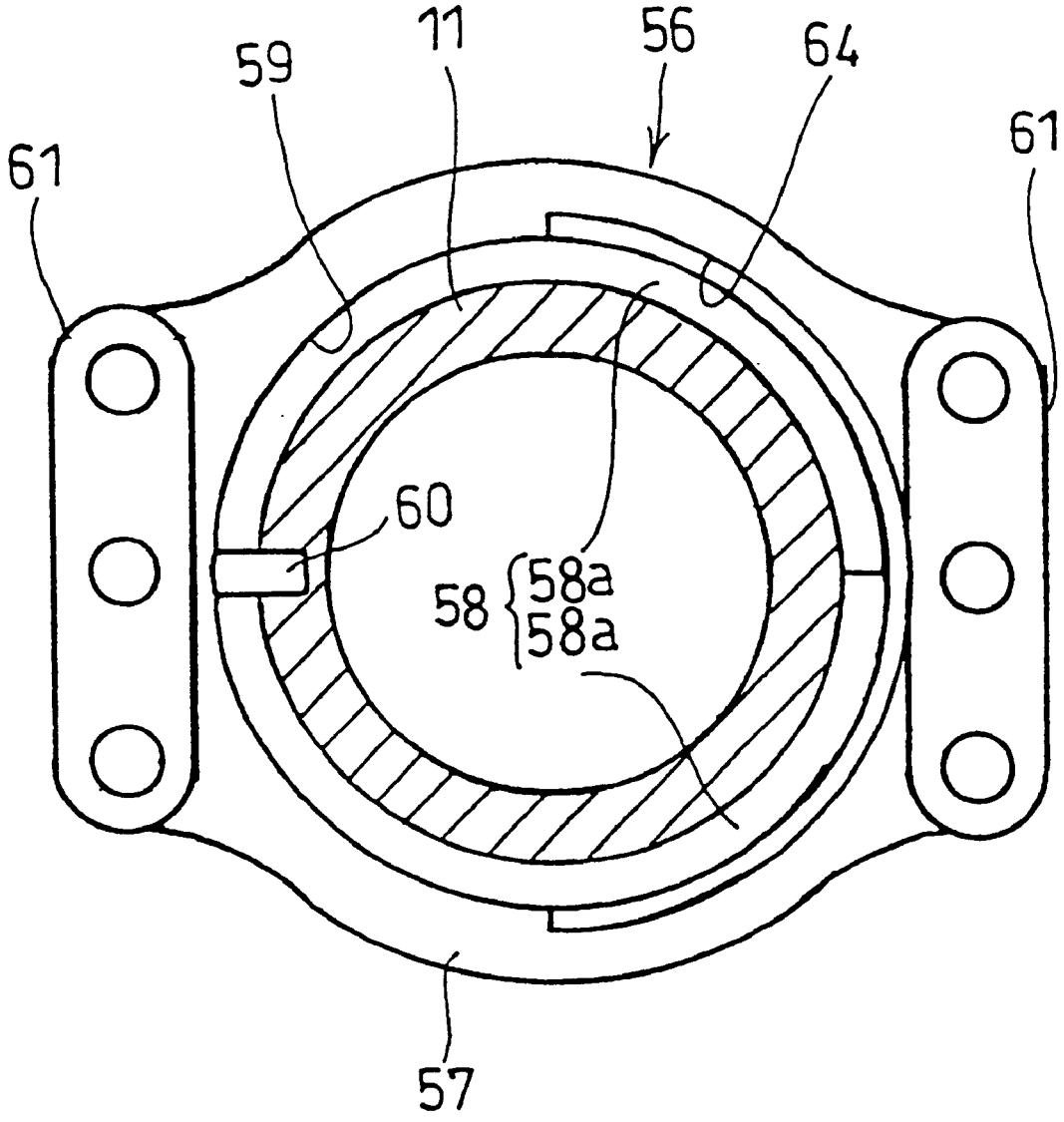
FIG. 14 is a side view of a holder.
Figure 15:
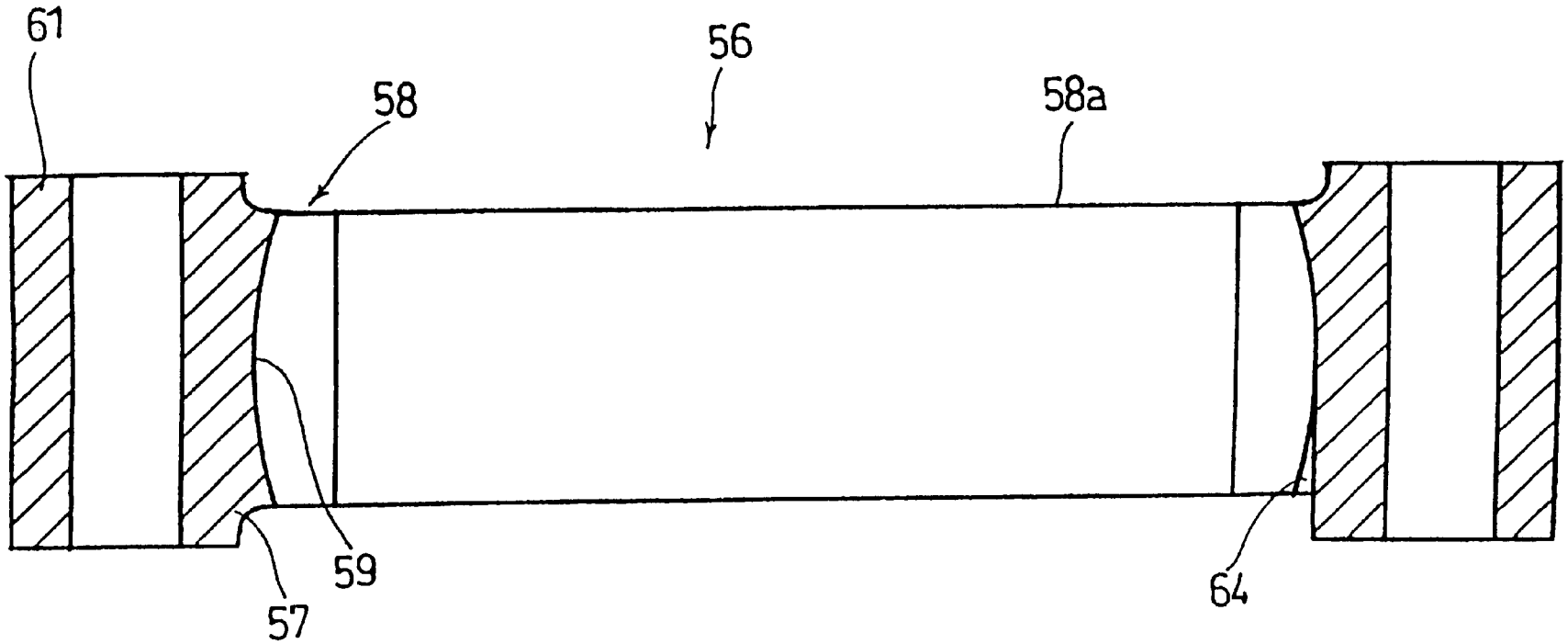
FIG. 15 is a sectional view of the holder.

Subsequently, the case 57 is rotated 90 degrees in the direction indicated by an arrow in FIG. 16(2). As a result, as shown in FIG. 14, one and the other halves constituting the collar 58 are displaced from the cutout 64. The collar 58 is thereby retained in place to complete the attaching operation. In this way, the holder 56 is easily attached (assembled) to the rear axle case 11.

In this state, the case 57 is fixed to the rear mounting members 50 and 51 of reinforcing frame 33 as noted hereinbefore.

The outer rear mounting member 50 of each of the right and left frame portions 36 has a safety frame mount 66 formed in an upper rear position on the transversely outward surface thereof. The safety frame mount 66 receives and fixedly supports a lower end of one of two posts of an inverted U-shape safety frame 65.

With the safety frame mounts 66 formed on the outward surfaces of outer rear mounting members 50 as noted above, an increased space is provided for accommodating the knees of the operator seated on the driver's seat 13 in the rearward facing position.

The safety frame 65 has brackets 67 projecting forward from lower positions of the posts. The brackets 67 are bolted to inward surfaces of the rear wheel fenders 12.

As shown in FIGS. 5, 12, 17 and 18, each of the right and left side frame portions 35 has a load receiving member 68 welded to and projecting rearward from the rear end thereof. The receiving member 68 defines a recess 69 opening upward.

The recesses 69 of right and left receiving members 68 are located in substantially the same position as a PTO shaft 70 with respect to the fore and aft direction (i.e. adjacent the lower rear end of transmission case 7), below the PTO shaft 70, and at opposite, right and left sides of PTO shaft 70.

Above each receiving member 68 is a mount bar 71 having a transverse axis. The mount bar 71 is fixed between the right and left rear mounting members 50 and 51.

The outer rear mounting member 50 has a restrictor formed on a lower rear position thereof and projecting above the recess 69, in side view, for limiting an upward movement of a connecting bar 72 on the backhoe fitted in the recess 69. The restrictor 79 is disposed below a lower surface adjacent the rear end of transmission case 7.

The right and left mounting elements 22 fixed to the front of base block 21 of backhoe 4 are disposed rearwardly of the rear frame portions 36 of reinforcing frame 33, respectively.

The connecting bar 72 having a transverse axis extends between lower positions of the right and left mounting elements 22. Transversely opposite ends of the connecting bar 72 project outwardly of the mounting elements 22.

Each of the right and left mounting elements 22 has a coupling 74 disposed above the connecting bar 72 and on a transversely outward surface. The coupling 74 has a pair of mount holders 73 vertically opposed to each other.

The coupling 74 includes the mount holders 73 supported on the mounting element 22 to be pivotable between an open position and a closed position, a biasing device 75 for biasing the mount holders 73 toward the open position, and a locking device 76 for retaining the mount holders 73 in the closed position.

The pair of upper and lower mount holders 73 are pivotally supported by upper and lower support shafts 77 attached to the outward surface of the mounting element 22 and having axes extending transversely of the tractor body. Thus, the mount holders 73 are pivotable toward and away from each other. Opposed surfaces of the mount holders 73 define arcuate recesses 78 for engaging the mount bar 71 attached to the reinforcing frame 33 on the tractor 2. The mounting element 22 laterally of the recesses 78 is cut out in U-shape not to interfere with the mount bar 71 when the pair of mount holders 73 and the mount bar 71 are connected.

The locking device 76 is disposed rearwardly of the mount holders 73. When the mount holders 73 are closed, the locking device 76 is inserted between rear ends of the mount holders 73 to prevent opening thereof, i.e. to retain the mount holders 73 in the closed position.

Figure 18:
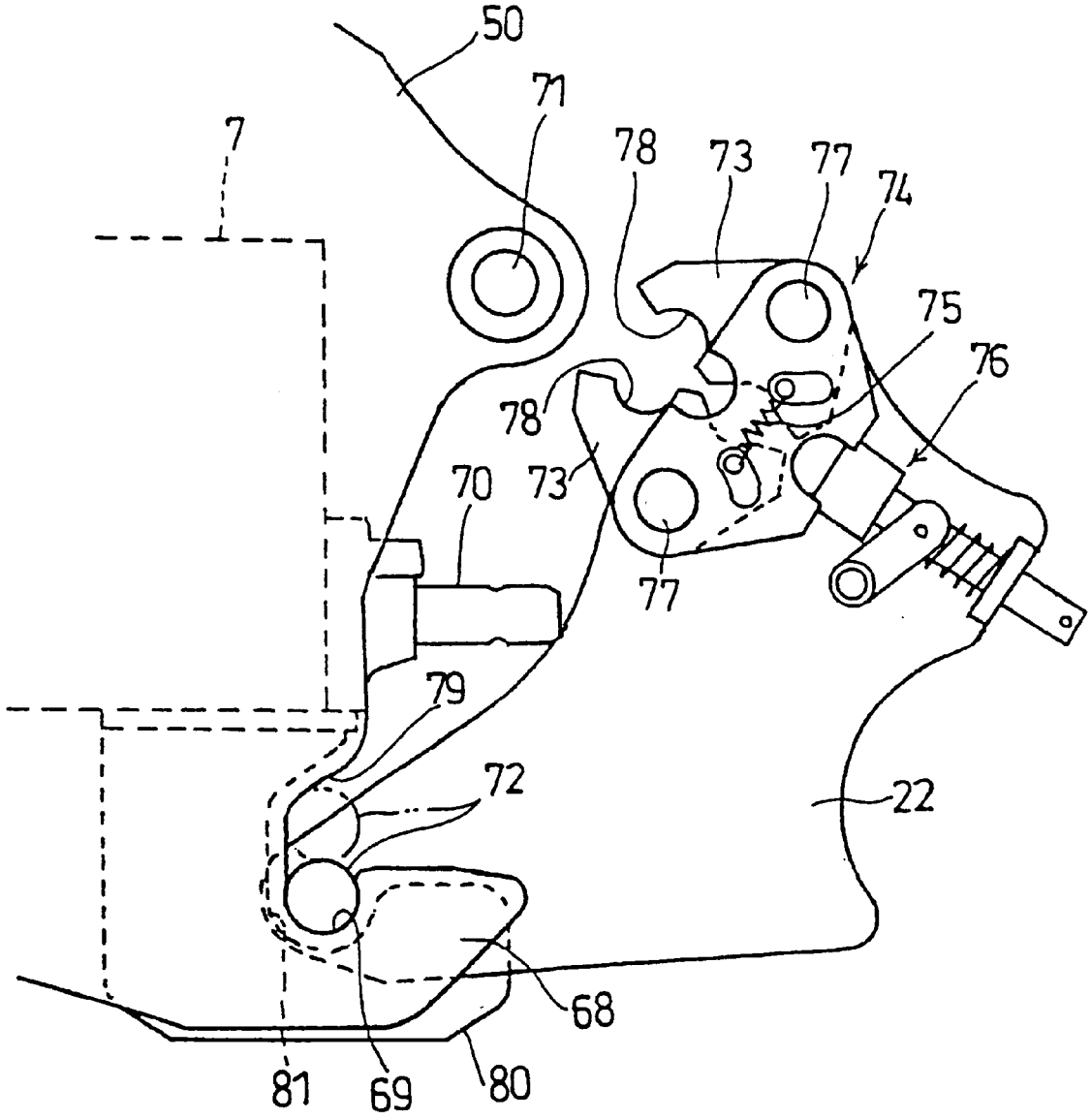
FIG. 18 is a side view of a backhoe connection.

With the above construction, an operation to connect the backhoe 4 to the tractor 2 is carried out as follows. When the backhoe 4 is detached from the tractor 2, as shown in FIG. 18, the mount holders 73 are opened by the biasing device 75. Before attaching the backhoe 4 to the tractor 2, the locking device 76 is placed in contact with rear surfaces of the mount holders 73. The connecting bar 72 is in a position shown in phantom lines in FIG. 18. The backhoe 4 is maintained with the right and left outriggers 27 and bucket 26 resting on the ground.

To attach the backhoe 4 to the tractor 2, the tractor 2 is moved backward to place the recesses 69 of receiving members 68 under the connecting bar 72. (When the connecting bar 72 is not in the position shown in the phantom lines, the outriggers 27, boom 25 and the like are operated to move the connecting bar 72 over the recesses 69.)

Next, the outriggers 27 are raised to lower the backhoe 4 to move the connecting bar 72 into the recesses 69 of receiving members 68 from above. Then, as shown in solid lines in FIG. 18, the connecting bar 72 is connected to the receiving members 68 to be rotatable about a transverse axis. At this time, each mount bar 71 is disposed forwardly of the mount holders 73.

Next, the arm cylinder 31 or bucket cylinder 32 is operated to swing the base block 21 and mounting elements 22 of the backhoe 4 forward about the connecting bar 72, to move the mount holders 73 closer to the tractor 2.

Figure 17:
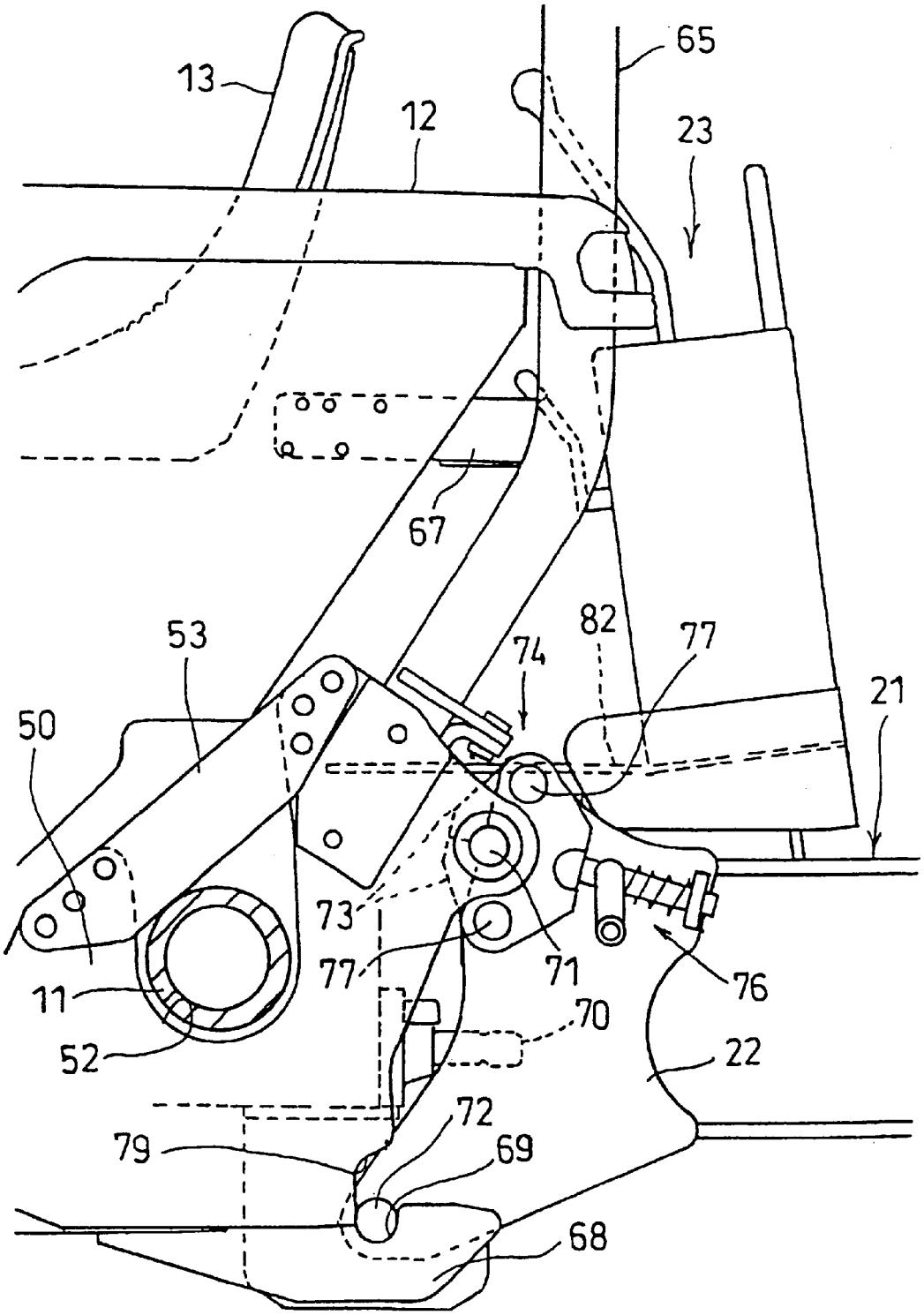
FIG. 17 is a side view of a rear portion of the tractor.

Then, as shown in FIG. 17, each mount bar 71 is inserted between the mount holders 73, and rear ends of the arcuate recesses 78 are pressed by the mount bar 71. The mount holders 73 are thereby closed against the force of biasing device 75. The mount bar 71 is now pinched between the mount holders 73.

As the mount holders 73 are closed, the rear ends of mount holders 73 are opened apart, and the locking device 76 is inserted between the rear ends of mount holders 73 by the biasing force of the spring, thereby preventing the mount holders 73 being opened by the biasing device 75. As a result, the mounting elements 22 of backhoe 4 are rigidly connected to the reinforcing frame 33 to attach the backhoe 4 to the tractor 2.

To detach the backhoe 4 in the attached state, the locking device 76 is retracted rearwardly of the mount holders 73, and an operation reversed from the above is carried out.

That is, the arm cylinder 31 or bucket cylinder 32 is operated first to swing the base block 21 and mounting elements 22 of backhoe 4 rearwardly about the connecting bar 72, to move the mount holders 73 away from the tractor 2.

Then, the mount holders 73 are opened to separate from the mount bar 71.

Next, the outriggers 27 are lowered to raise the backhoe 4 to move the connecting bar 72 upward out of the recesses 69 of receiving members 68. At this time, the connecting bar 72 contacts the restrictor 79 of outer rear mounting member 50 before the rear end of transmission case 7. Thus, the connecting bar 72 is prevented from interfering with the rear end of transmission case 7.

In this embodiment, the transmission case 7 has a mount 80 fixed to a lower rear surface thereof for attaching a drawbar for drawing a different working implement. The mount 80 defines a recess 81 to avoid interference with the connecting bar 72. Numeral 82 in FIG. 17 denotes a step of backhoe 4.

What is claimed is:

1. A front loader tractor comprising:

a tractor body;

a reinforcing frame disposed around said tractor body and supported by said tractor body;

a pair of right and left side frames for pivotably supporting a pair of right and left booms having a loader bucket attached to distal ends thereof;

braces for connecting said side frames to said tractor body; and connecting means for connecting said side frames to each said reinforcing frame, said connecting means including:

at least two connected bosses attached to each said side frames, forming a pair of connected bosses at each said side frame;

at least two connecting bosses attached to said reinforcing frame for each pair of connected bosses attached to said side frames; and pins inserted through bores of said connected bosses and bores of said connecting bosses.

2. A tractor-loader-backhoe comprising:

a tractor body;

a reinforcing frame disposed around said tractor body and supported by said tractor body;

a pair of right and left side frames for pivotably supporting a pair of right and left booms having a loader bucket attached to distal ends thereof;

braces for connecting said side frames to said tractor body;

connecting means for connecting said side frames to said reinforcing frame, said connecting means including;

at least two connected bosses attached to each said side frames forming a pair of connected bosses for each said side fame;

at least two connecting bosses attached to said reinforcing frame for each pair of connected bosses and attached to said side frames; and pins inserted through bores of said connecting bosses and bores of said connecting bosses;

front mounting members for attaching front positions of said reinforcing frame to said tractor body; and rear mounting means for attaching rear positions of said reinforcing frame to cylindrical portions of rear axle cases, said rear mounting means including:

holders rotatable about an axis of said cylindrical portions; and mounting members for connecting said holders to said reinforcing frame, respectively.

3. A tractor-loader-backhoe as defined in claim 2, wherein said mounting members are connected to said backhoe, is connecting, and possible.

4. A tractor-loader-backhoe as defined in claim 2, wherein said mounting members and said holders are bolted to together.

5. A tractor-loader-backhoe comprising:

a tractor body;

a reinforcing frame disposed around said tractor body and supported by said tractor body;

a pair of right and left side frames for pivotably supporting a pair of right and left booms having a loader bucket attached to distal ends thereof;

braces for connecting said side frames to said tractor body;

pin connecting means for connecting said side frames to said reinforcing frame;

front mounting members for attaching front positions of said reinforcing frame to said tractor body; and rear mounting means for attaching rear positions of said reinforcing frame to cylindrical portions of rear axle cases, said rear mounting means including:

collars mounted on said cylindrical portions and circumferentially divided;

boss holders mounted on said collars, said boss holders and said collars contact each other through curved surfaces for allowing a relative rotation therebetween; and mounting members for connecting said boss holders to said reinforcing frame, respectively.

6. A tractor-loader-backhoe as defined in claim 5, wherein each of said boss holders defines a cutout for allowing one of said collars to be attached from an axial direction thereof.

7. A tractor-loader-backhoe as defined in claim 6, wherein said pin connecting means includes at least two connected bosses attached to each said side frame, wherein each said side frame includes a pair of two connected bosses;

at least two connecting bosses attached to said reinforcing frame for each of the said pair of connected bosses; and pins insertable through bores of said connected bosses and bores of said connecting bosses.

8. A tractor-loader-backhoe as defined in claim 5, wherein said pin connecting means includes at least two connected bosses attached to each said side frame, wherein each said side frame includes a pair of two connected bosses;

at least two connecting bosses attached to said reinforcing frame for each of the said pair of connected bosses; and pins insertable through bores of said connected bosses and bores of said connecting bosses.

* * * * *

UNITED STATES PATENT AND TRADEMARK OFFICE

CERTIFICATE OF CORRECTION

PATENT NO. : 6,446,367 B1
DATED : September 10, 2002
INVENTOR(S) : Naoya Muramoto et al.

It is certified that error appears in the above-identified patent and that said Letters Patent is hereby corrected as shown below:

Column 3,
Line 48, "night side" should read -- right side --.

Column 4,
Line 39, "FIGS. 2 trough" should read -- FIGS. 2 through --.

Signed and Sealed this

Eighteenth Day of February, 2003

JAMES E. ROGAN
*Director of the United States Patent and Trademark Office*